United States Patent [19]

Ishido et al.

[11] Patent Number: 4,932,442

[45] Date of Patent: Jun. 12, 1990

[54] PRELIMINARY JET FEEDFORWARD WEFT INSERTION CONTROL SYSTEM FOR JET LOOM

[75] Inventors: Takao Ishido, Higashikurume; Shinji Wakai, Mitaka, both of Japan

[73] Assignee: Nissan Motor Co., Ltd., Yokohama, Japan

[21] Appl. No.: 340,745

[22] Filed: Apr. 20, 1989

[30] Foreign Application Priority Data

Jul. 12, 1988 [JP] Japan ..... 63-173270

[51] Int. Cl.[5] ..... D03D 47/30; D03D 47/34

[52] U.S. Cl. ..... 139/435.2; 139/452

[58] Field of Search ..... 139/435, 452

[56] References Cited

U.S. PATENT DOCUMENTS

| | | | |
|---|---|---|---|
| 4,378,821 | 4/1983 | Umezawa | 139/452 |
| 4,450,876 | 5/1984 | van Mullekom | 139/435 |
| 4,463,783 | 8/1984 | Suzuki et al. | 139/435 |
| 4,503,891 | 3/1985 | Novak et al. | 139/435 X |
| 4,559,976 | 12/1985 | Araki et al. | 139/435 |
| 4,658,865 | 4/1987 | Gotoh | 139/435 |
| 4,673,005 | 6/1987 | Kawajiri | 139/452 X |
| 4,756,341 | 7/1988 | Takehana | 139/435 |
| 4,766,937 | 8/1988 | Kojima et al. | 139/452 |
| 4,781,224 | 11/1988 | Gotoh et al. | 139/435 |

FOREIGN PATENT DOCUMENTS

| | | |
|---|---|---|
| 60-162837 | 8/1985 | Japan . |
| 60-162838 | 8/1985 | Japan . |

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

In a fluid jet loom, a weft inserting condition such as a fluid jet pressure is controlled by a feedforward control in which a change of a weft yarn condition due to interaction between the weft yarn and fluid jet is detected, and an anticipating corrective action is taken before the weft yarn is allowed to move into the shed.

20 Claims, 8 Drawing Sheets

PRELIMINARY JET FEEDFORWARD WEFT INSERTION CONTROL SYSTEM FOR JET LOOM

BACKGROUND OF THE INVENTION

The present invention relates to a weft insertion system and method for a fluid jet loom which can provide optimum weft inserting performances in accordance with an instantaneous condition of a weft yarn.

Japanese Patent Provisional Publication No. 60-162837 shows a weft insertion method in which a weft tension is detected during weft insertion, and a weft inserting condition such as a pressure or timing of a fluid jet is controlled in accordance with a difference between the sensed weft tension and a predetermined standard.

In this method, the weft yarn condition is detected during the weft insertion period. Therefore, the corresponding corrective action is not possible until the next weaving cycle because of limitations in the response speed of a pressure regulator and valve. In this sense, this control method is a feedback control. In such a feedback control however, it is difficult or impossible to make uniform the timing of the termination of the weft insertion especially in the case of spun yarn (cotton yarn) whose properties are not even along the yarn length. This tends to create mispick and deterioration of woven fabric quality. The unevenness of the spun yarn affects the timing of termination of the weft insertion by affecting the pulling force applied on the yarn by the fluid jet stream, and hence the initial acceleration of the weft yarn.

Japanese Patent Provisional Publication No. 60-162838 shows another weft insertion method, which is designed to measure a flying velocity of a weft yarn by sensing a change of an amount of a stored weft yarn during weft insertion, and to control a weft inserting condition such as the fluid jet pressure, in accordance with the result of the measurement. However, this method is also unsatisfactory in that the corrective action cannot be effected within the same weaving cycle. This is true especially in recent high speed looms. When the operating speed of a loom is as high as 800 rpm, for example, the speed of weft insertion must be about 25 m/s. At such a high speed, this conventional method is not appropriate to control the weft inserting condition before the weft insertion. When the air pressure in an air jet loom is changed between a low pressure and a high pressure by switching over from a high pressure air tank to a low pressure air tank, a residual high pressure air considerably retards the actual change of the air pressure. In such a case, this method is unable to immediately make a proper air pressure wave form.

SUMMARY OF THE INVENTION

It is an object of the present invention to provide a weft insertion system and method which can eliminate the irregularity in the timing of termination of weft insertion, thereby insuring optimum weft insertion performance.

According to the present invention, a weft insertion system for a fluid jet loom such as an air jet loom comprises (i) weft inserting means comprising a weft inserting main jet nozzle, (ii) supplying means such as a weft supply package for supplying a weft yarn to the weft inserting main nozzle, (iii) sensing means disposed between the supplying means and the main nozzle for sensing a condition of the weft yarn such as a weft tension and a frictional force before the weft yarn is inserted into a warp shed, and (iv) controlling means connected with the weft inserting means for controlling a weft inserting condition such as a fluid jet pressure, a duration of the fluid jet for weft insertion, and a timing of weft insertion, in accordance with an output signal produced by the sensing means.

The sensing means may comprise preliminary fluid jet means for applying a pulling force on the weft yarn at a forward position by a fluid jet while the weft yarn is still prevented from flying into the shed. The preliminary fluid jet means may be connected with the main nozzle, and arranged to apply the pulling force on the weft yarn by causing the main nozzle to produce the fluid jet while the weft yarn is still detained. Alternatively, the preliminary fluid jet means may comprise secondary fluid jet nozzle for pulling or ejecting the weft yarn by a fluid jet before the weft insertion by the main nozzle.

A weft insertion method according to the present invention comprises a first step of sensing a condition of a weft yarn while preventing the weft yarn from moving into a shed, a second step of producing a corrective signal in accordance with the condition of the weft yarn, and a third step of allowing the weft yarn to move into the shed. The first step may be accomplished by applying a force on the weft yarn by a fluid jet while the weft yarn is still prevented from flying into the shed, and sensing the condition of the weft yarn on which the force is applied.

DETAILED DESCRIPTION OF THE INVENTION

A first embodiment of the present invention is shown in FIGS. 1–5.

Figure 2:
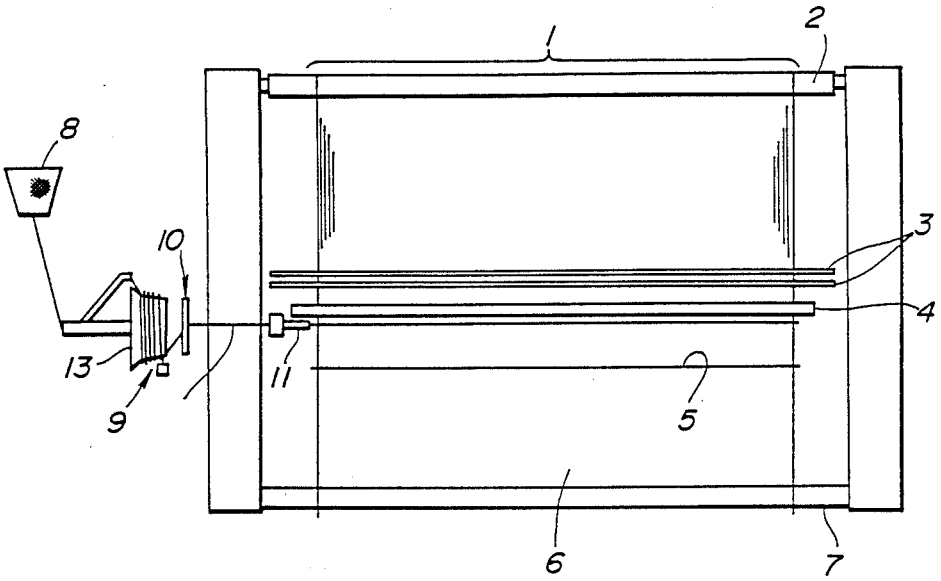
FIG. 2 is a schematic plan view showing a fluid jet loom of the first embodiment.

FIG. 2 shows an air jet loom including a back roller 2 for carrying warp yarns 1, healds 3, a reed 4 confronting a cloth fell 5, and a breast beam 7 for carrying a woven cloth 6. A weft yarn is supplied from a weft supply package 8, through a weft storage unit 9 and a weft guide 11 to a weft inserting main nozzle 11 which swings with the reed 4 as an integral unit. The weft guide 10 is disposed between the wet storage unit 9 and the main nozzle 11, and serves both as a guide and a tension detector.

Figure 1:
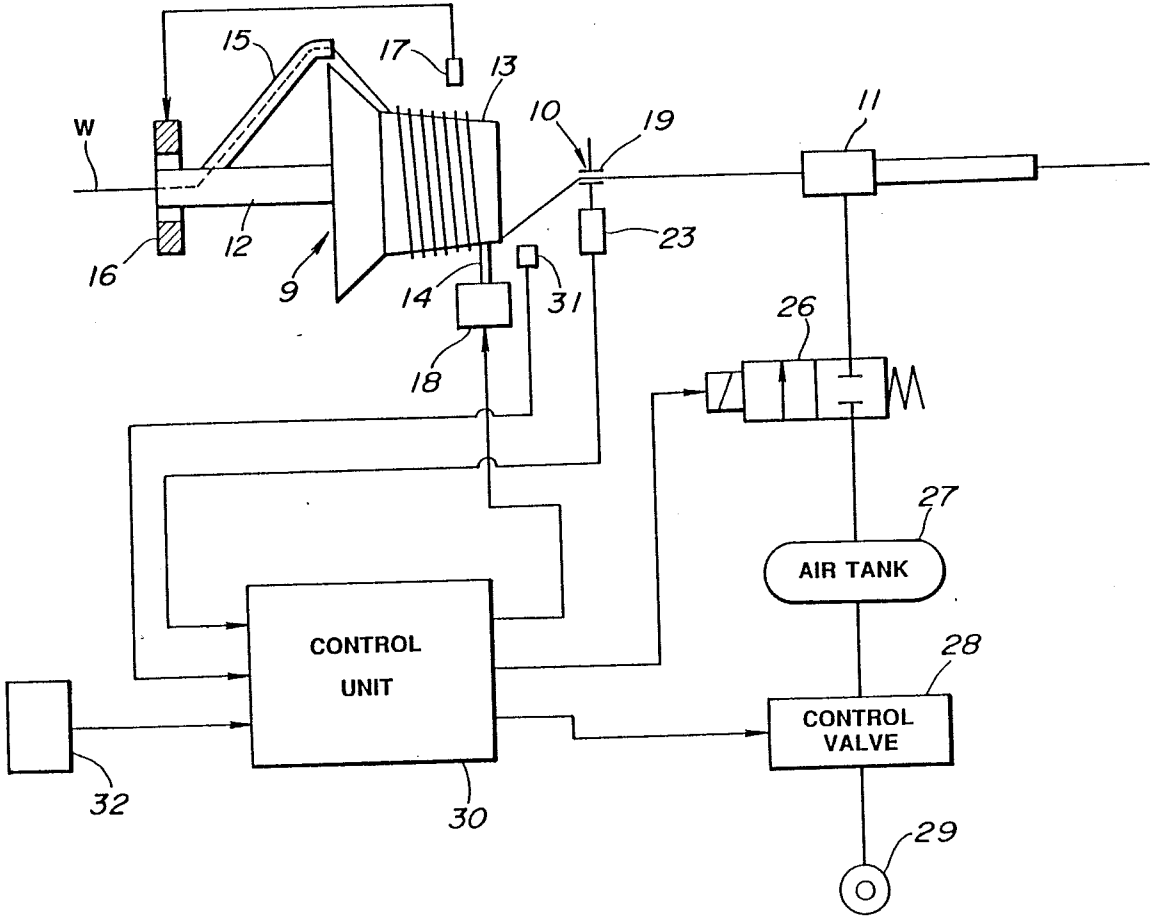
FIG. 1 is a schematic view of a main portion of a weft insertion system according to a first embodiment of the present invention.

FIG. 1 shows a main portion of the loom shown in FIG. 2. The weft storage unit 9 has a drum 13 which is rotatably mounted on a rotating shaft 12. The shaft 12 is rotatable relative to the drum 13, but the drum 13 is held stationary. The weft storage unit 9 further includes a detaining pin 14, and a winder arm 15 projecting from the rotating shaft 12. The detaining pin 14 is projected into a hole formed in the peripheral surface of the drum 13 to detain the weft yarn, and withdrawn from the hole to release the weft yarn at predetermined controlled timings. The weft yarn W from the supply package 8 is wound on the drum 13 by the winder arm 15 rotating around the drum 13 by being driven by a motor 16. A winding amount sensor 17 is arranged to sense a winding amount which is an amount of the yarn wound on the drum 13. The rotation of the winder arm 15 is stopped when the winding amount sensed by the sensor 17 reaches a predetermined value.

The detaining pin 14 is projected and withdrawn by an electromagnetic actuator 18. When the detaining pin 14 is disengaged from the drum 13, the weft yarn W wound on the drum 13 is allowed to proceed to the main nozzle 11 for the air jet weft insertion operation. After a predetermined time interval, the detaining pin 14 is engaged with the drum 13 again to prevent the weft yarn W from being drawn out from the drum 13, and the weft insertion is completed. U.S. Pat. Nos. 4,378,821; 4,766,937 and 4,658,865 disclose similar weft storage devices.

Figure 3:
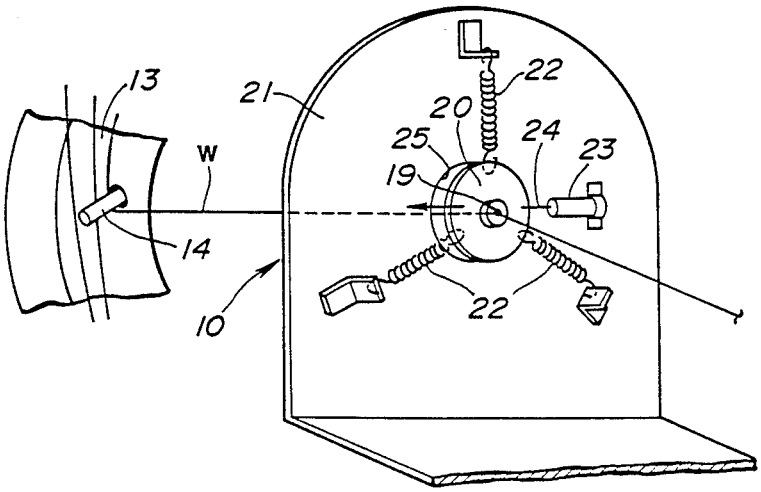
FIG. 3 is a perspective view of a weft yarn guide shown in FIG. 1.

The weft guide 10 of this embodiment is shown in FIG. 3. The weft guide 10 includes a guide piece 19, a guide plate 20, and a support member 21. The guide piece 19 is fixedly mounted on the guide plate 20, which is supported on the support member 21 through three helical tension springs 22 so that the guide plate 20 is floating. A tension sensor 23 is fixed to the support member 21. The guide plate 20 is connected with the tension sensor 23 by a wire 24. The support member 21 has an opening 25 through which the weft yarn W extends. When the detaining pin 14 detains the weft yarn W as shown in FIG. 3, the weft yarn W is bent at the guide piece 19 so that an angle is formed by the weft yarn W in a plane. The wire 24 and tension sensor 23 are placed in this plane.

The weft inserting main nozzle 11 is connected through an electromagnetic valve 26, an air tank 27 and an electropneumatic proportional pressure control valve 28, with a pressurized air source 29, as shown in FIG. 1.

Figure 4:
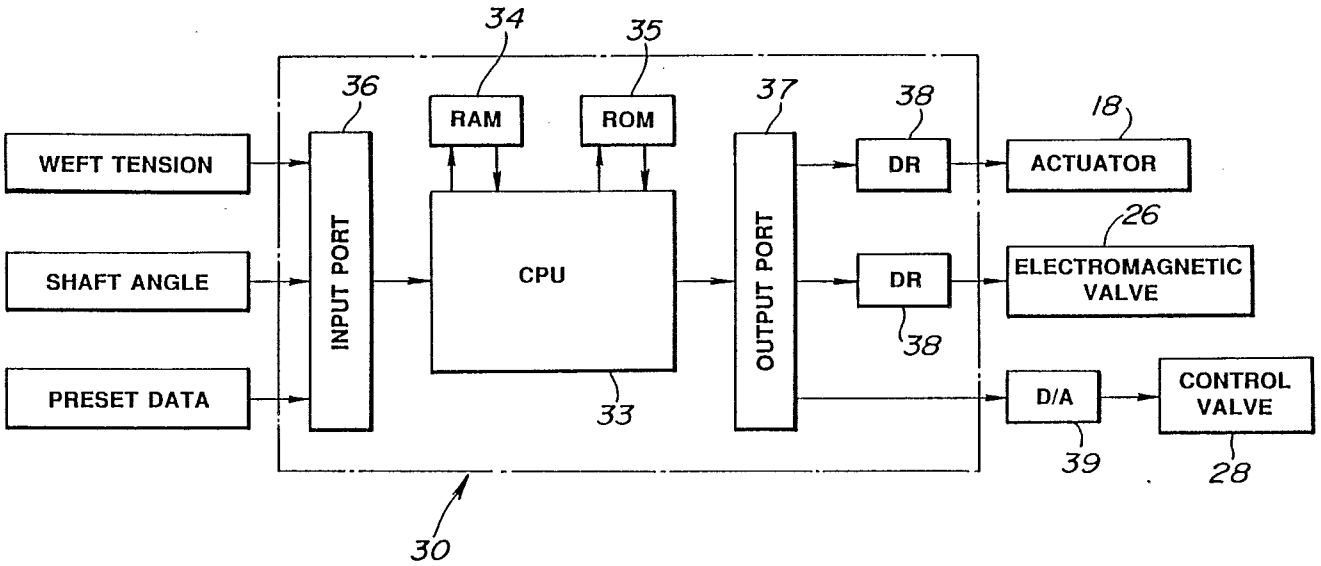
FIG. 4 is a block diagram of a control unit shown in FIG. 1.

A control unit 30 is provided for controlling the electromagnetic actuator 18, electromagnetic valve 26 and electropneumatic pressure control valve 28. The control unit 30 is connected with an unwinding amount sensor 31, an angle sensor 32 and the above-mentioned weft tension sensor 23. The unwinding amount sensor 31 senses an unwinding amount which is an amount of the weft yarn unwound from the storage drum 13. The angle sensor 32 of this embodiment is a rotary encoder which senses an angular displacement of a main shaft of the loom. Signals of these sensors are inputted into the control unit 30. A main component of the control unit 30 of this embodiment is a microcomputer. As shown in FIG. 4, the control unit 30 of this embodiment includes a CPU 33, a RAM 34, a ROM 35, input and output ports 36, 37, and drivers 38. A weft tension signal of the sensor 23, an angle signal of the signal of the sensor 32 and various preset signals are inputted to the CPU through the input port 36. The CPU 33 processes these input signals, and delivers control signals through the output port 37 to the actuator 18, electromagnetic valve 26 and control valve 28. A digital to analog converter 39 is provided between the control unit 30 and the control valve 28. In this embodiment, the timing of withdrawal of the detaining pin 14, the timing of opening of the electromagnetic valve 26, and an initial pressure of the electropneumatic pressure control valve 28 are preset.

Figure 5:
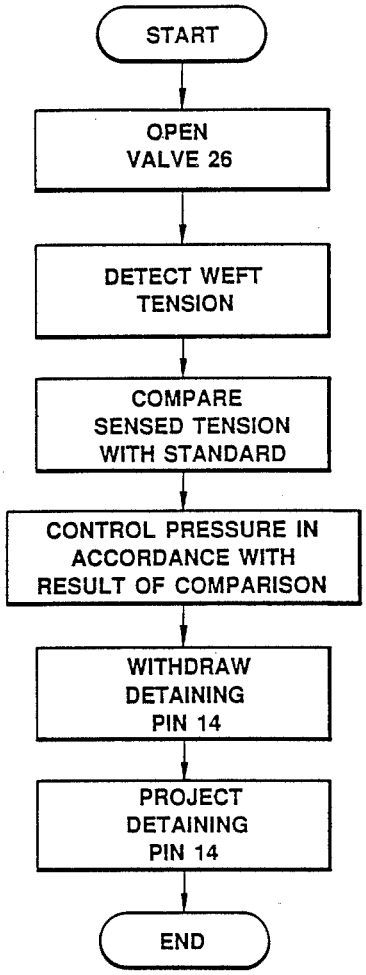
FIG. 5 is a flowchart for showing operations of the weft insertion system, and a weft insertion method, of the first embodiment.

FIG. 5 shows control operations performed by the control system of the first embodiment. After a start of the loom, the control unit 30 first opens the electromagnetic valve 26 at the instant at which the loom main shaft angle reaches the preset angle. At this time, the detaining pin 14 remains engaged with the drum 13, and detains the weft yarn W. On the other hand, the weft yarn W preliminarily inserted in the main nozzle 11 is pulled in the weft inserting direction by the air jet of the main nozzle 11. As a result, a tension is developed in the weft yarn W. This weft tension exerts, a force on guide piece 19 and guide plate 20, tending to displace guide piece 19 and guide plate 20. The tension sensor 23 is designed to sense the weft tension by sensing this force applied on guide piece 19 and plate 20.

Then, the control unit 30 compares the actual weft tension value sensed by the tension sensor 23, with a predetermined reference value. If the actual tension value is greater than the reference value, then the control unit 30 judges that the weft yarn W is acted upon by a traction force, or pulling force, greater than a predetermined reference magnitude, and that the initial acceleration at the initial stage of the weft insertion will be higher than a reference value. According to this judgement, the control unit 30 decreases the pressure of the electropneumatic pressure control valve 28 by an amount corresponding to the deviation from the reference. If the sensed actual tension is smaller than the reference value, then the control unit 30 considers the pulling force acting on the weft yarn W to be smaller than the reference magnitude, and increases the pressure of the electropneumatic pressure control valve 28 by an amount corresponding to the deviation. After the pressure is controlled in dependence on the result of the comparison between the sensed weft tension and the reference tension, the control unit 30 disengages the detaining pin 14 from the drum 13 by actuating the electromagnetic actuator 18. As a result, the weft yarn W starts moving through the shed.

In this way, the control system of this embodiment detects the weft tension and corrects the weft inserting condition within the period between an end of each weft insertion, and a start of the next weft insertion. This control system performs the feedforward control in which the tension acting on the weft yarn is detected and compared with the standard, and a corrective action is applied to the air jet pressure of the main nozzle 11 prior to the weft insertion. Therefore, the flight velocity of the weft yarn W and the weft inserting force are varied, and the timing of termination of the weft insertion is made substantially uniform pick to pick independent of changes in conditions of the weft yarn i.e. yarn thickness.

An actual carrying force for carrying the weft yarn W is substantially equal to a difference resulting from subtraction from the pulling force applied to the weft yarn W, a drag such as a resistive force (caused by factors such as ballooning resistance, and yarn weight). Therefore, it is optional to control the air pressure of the electropneumatic pressure control valve 28, or the timing or duration of the air jet, in accordance with the actual carrying force which is obtained by preliminarily storing these factors and calculating the drag based on these factors.

In this embodiment, the directly controlled variable is the pressure of the electropneumatic pressure control valve 28. However, it is possible to control the pulling force by controlling the air pressure of its auxiliary air jet nozzles (not shown), the timing or duration of opening of the electromagnetic valve 26, or the timing of withdrawal of the detaining pin 14, instead of controlling the air pressure of the main nozzle 11.

When the unwinding amount of the weft yarn sensed by the unwinding amount sensor 31 reaches a predetermined amount after the start of the flight of the weft yarn, the control unit 30 actuates the electromagnetic actuator 18 again to cause the detaining pin 14 to project into the drum 13. Therefore, the weft yarn W is prevented from being drawn out from the drum 13, and the weft insertion operation terminates. In this way, the control system of this embodiment regularly repeats the weft inserting process in every weaving cycle.

The tension sensor 23 may be constructed in various manners. For example, a piezoelectric element is disposed between the guide plate 20 and the guide piece 19. In this case, there is no need for supporting the guide piece in the floating state. Therefore, the piezoelectric type tension sensor is advantageous in many cases. Furthermore, it is possible to sense the weft tension by sensing a force applied on the detaining pin 14 by the weft yarn W, by sensing a deflection of the detaining pin 14.

Figure 6:
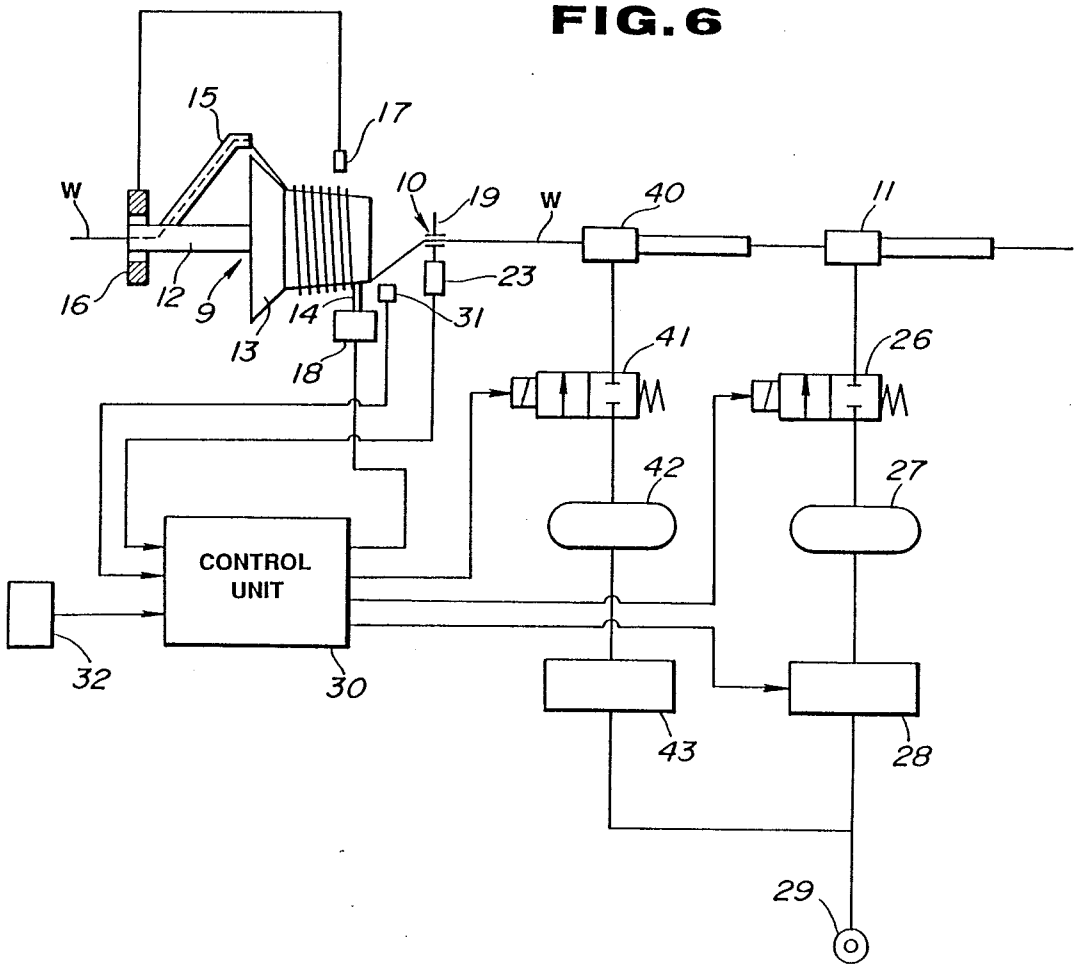
FIG. 6 is a schematic view, similar to FIG. 1, but showing a second embodiment of the present invention.

A second embodiment of the present invention is shown in FIG. 6. The control system of the second embodiment is almost the same as that of the first embodiment, but it additionally includes a booster nozzle 40 (a secondary fluid jet nozzle), which is connected with the pressurized air source 29 through a second electromagnetic valve 41, a second air tank 42 and a regulator 43. The booster nozzle 40 is disposed in the path of the weft yarn between the weft guide 10 and the main nozzle 11. The booster nozzle 40 is substantially identical in construction to the main nozzle 11. The second electromagnetic valve 41 is connected with the control unit 30 so that the control unit 30 can open and close the second electromagnetic valve 41.

In the second embodiment, the control unit 30 opens the second electromagnetic valve 41 prior to the weft insertion. Therefore, the weft yarn W is pulled by the booster nozzle 40, and the weft tension is sensed by the weft tension sensor 23. In accordance with the sensed weft tension, the control unit 30 controls the pressure of the electropneumatic pressure control valve 28 in the same manner as in the first embodiment. Thereafter, the control unit 30 opens the main electromagnetic valve 26, and withdraws the detaining pin 14 from the drum 13 to start the weft insertion. At an end of a predetermined time interval, the control unit 30 terminates the weft insertion by engaging the detaining pin 14 with the drum 13. The electromagnetic valves 26 and 41 are closed prior to the termination of the weft insertion.

In this case, it is possible to employ a feedback control to control the air jet pressure or other conditions in accordance with an average of the sensed actual weft tension values taken over a plurality of picks.

Figure 7:
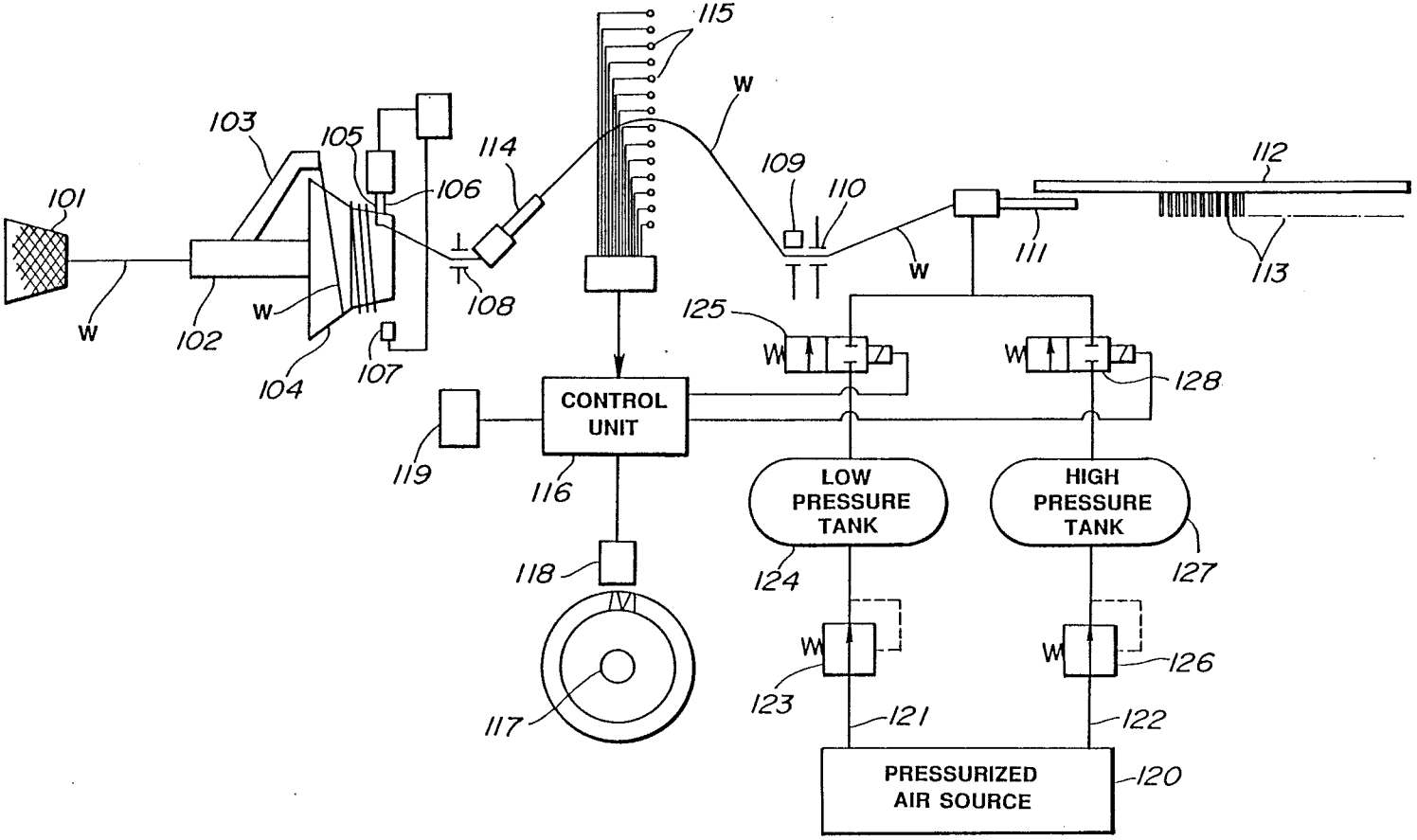
FIG. 7 is a schematic view, similar to FIG. 1, but showing a third embodiment of the present invention.
Figure 8:
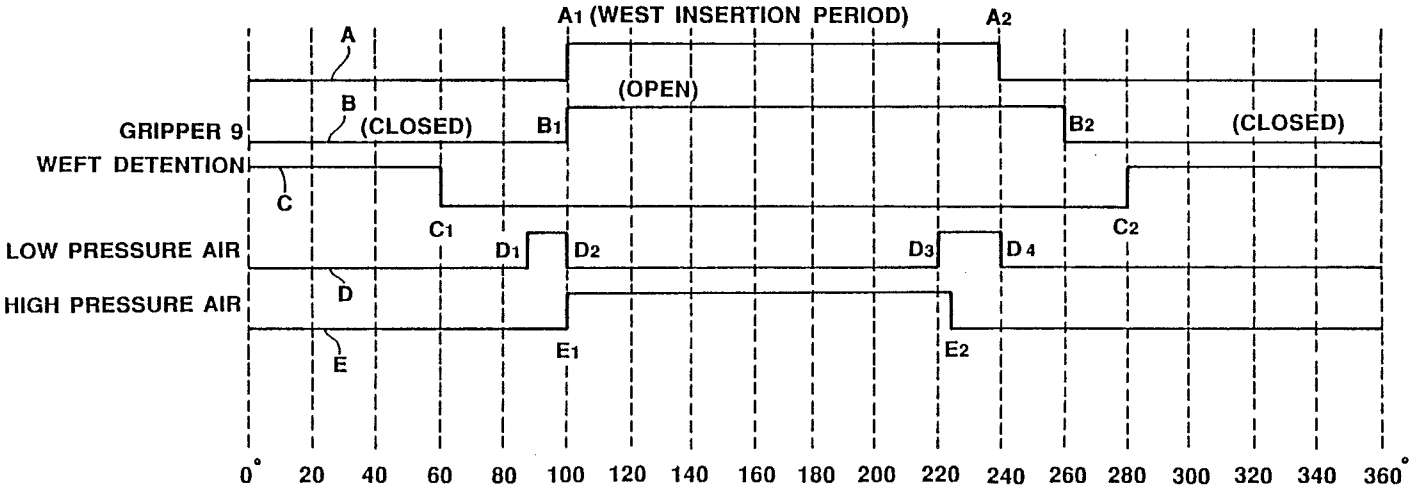
FIG. 8 is a diagram for showing operations of the second embodiment.

A third embodiment of the present invention is shown in FIGS. 7, and 8.

As shown in FIG. 7, a weft yarn W drawn out from a weft supply package 101, passes through a rotating shaft 102 connected with a drive system of the loom, and a winder arm 103, and the weft yarn W is wound on a weft storage drum 104 by the winder arm 103. The drum 104 is rotably mounted on the rotating shaft 102, and held stationary by a magnet (not shown). There are further provided weft detaining pins 105 and 106, a photoelectric type weft unwinding amount sensor 107 for sensing the unwinding amount of the weft yarn which is the amount of the weft yarn taken out from the storage drum 104, a weft guide 108, a weft gripper 109, a weft guide 110, a weft inserting main nozzle 111, a reed 112, and a plurality of weft guide members 113 arranged on a race member (not shown) supporting the reed 112.

In the third embodiment, a slant nozzle 114 (a secondary fluid jet nozzle) is disposed next to the weft guide 108, and a weft yarn sensor including a plurality of photoelectric type weft yarn detecting elements 115 are vertically arranged for detecting the weft yarn W ejected by the slant nozzle 114. The slant nozzle 114 is arranged to eject the weft yarn W in an upward direction deviating the horizontal and vertical directions, and the weft yarn sensor is arranged to sense the height of the ejected weft yarn.

A control unit 116 is connected with the weft yarn sensor 115, a rotation angle sensor 118 in the form of an encoder for sensing the phase of rotation of a main rotating shaft 117 of the loom, and a presetter 119.

A pressurized air source 120 is connected with the weft inserting main nozzle 111 by two parallel circuits, a first circuit 121 and a second circuit 122. In the first circuit 121, there are provided a low pressure regulator valve 123, a low pressure air tank 124, and an electromagnetic valve 125. The second circuit 122 includes a high pressure regulator valve 126, a high pressure air tank 127, and an electromagnetic valve 128. The electromagnetic valves 125 and 128 are connected with the control unit 116 so that the control unit 116 can open and close the valves 125 and 128.

FIG. 8 shows operations of the control system of the third embodiment, timed on the basis of the phase of rotation of the loom main shaft. A raised portion of an uppermost line A between $A_1$ and $A_2$ indicates a weft insertion period. A raised portion $B_1$–$B_2$ of a next line B is a period in which the weft gripper 9 is in a release state. During a period between points $C_1$ and $C_2$, the detaining members 5 and 6 release the weft yarn W. During periods $D_1$–$D_2$ and $D_3$–$D_4$, the electromagnetic valve 125 is opened, and the weft inserting nozzle 111 is supplied with the low pressure air of the first circuit 121. A lowermost line E shows the condition of the second circuit 122. During a period between $E_1$ and $E_2$, the electromagnetic valve 128 is opened, and the weft inserting nozzle 111 is supplied with the high pressure air.

The weft yarn W proceeds from the supply package 101 through the rotating shaft 102 and the winder arm 103, and is wound on the storage drum 104. Then, the weft yarn W is pulled from the storage drum 104, to the slant nozzle 114, and ejected upwardly by the slant nozzle 114. The weft yarn sensor 115 senses the height of the weft yarn ejected from the slant nozzle 114, and sends a signal representing the ejected condition of the weft yarn, to the control unit 116. The control unit 116 further receives the signal of the encoder 118 representing the phase angle of the rotation of the loom main shaft 117, and the data signals of the presetter 119.

The control unit 116 checks the frictional force of the weft yarn resulting from interaction between the weft yarn and air, prior to the weft insertion, and controls the electromagnetic valves 125 and 128 so as to obtain the optimum weft inserting condition.

Figure 9:
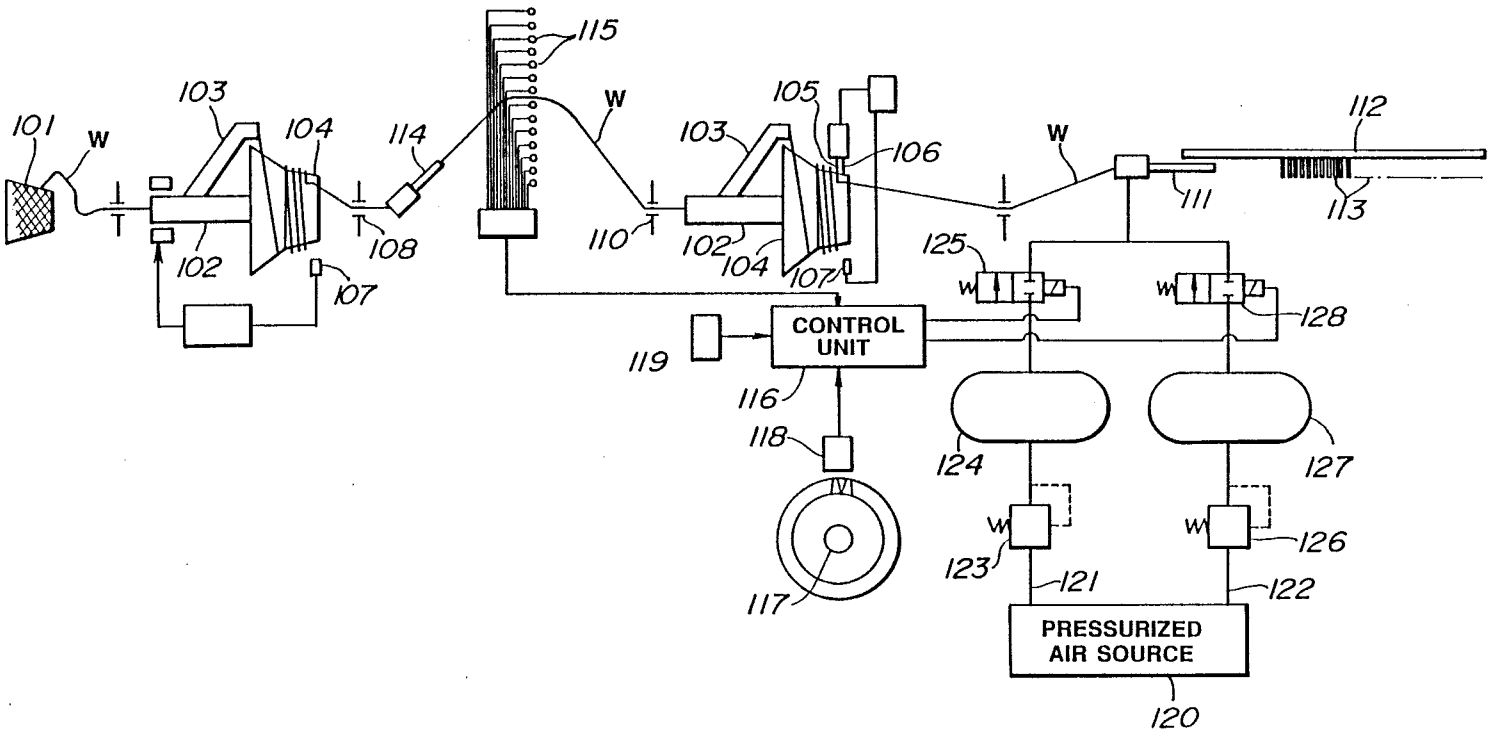
FIG. 9 is a schematic view, similar to FIG. 7, but showing a fourth embodiment of the present invention.

A fourth embodiment of the present invention is shown in FIG. 9.

A weft inserting system of the fourth embodiment is almost the same as that of the third embodiment. In the fourth embodiment, a second weft storage unit is provided between the weft yarn sensor 115 and the weft inserting main nozzle 111, for measuring the length of the weft yarn. The system of the fourth embodiment can improve the accuracy in the measurement of the weft yarn length. The second weft storage unit is substantially identical to the first weft storage unit provided between the supply package 101 and the slant nozzle 114.

In the present invention, it is possible to control any one or more of the air pressures of the weft inserting nozzle, the timing of emission of the air jet for weft insertion, the air pressure of the auxiliary nozzles, and the timing of emission of the air jet of the auxiliary nozzles, the timing of start of the weft insertion (i.e. the timing of movement of the detaining pin), and the timing of change between the high pressure and low pressure.

In the present invention, the weft tension or the compatibility between the weft yarn and the fluid jet is detected prior to the flight of the weft yarn into the shed, so that it is possible to control the various conditions affecting the weft insertion in a real time manner without delay. Therefore, the present invention can provide optimum weft inserting performance even in the case of spun yarns having a considerable unevenness in yarn thickness, and improve the fabric quality and the availability factor of the loom by lowering the possibility of mispick.

What is claimed is:

1. A weft insertion system for a fluid jet loom, comprising:

weft inserting means comprising a weft inserting main nozzle, supplying means for supplying a weft yarn to said weft inserting main nozzle, preventing means for preventing said weft yarn from moving into a shed, and allowing said weft yarn to move into said shed, sensing means, disposed between said supplying means and said main nozzle, for sensing a condition of said weft yarn before said weft yarn is inserted into said shed, said sensing means sensing said condition of said weft yarn while said weft yarn is prevented by said preventing means for moving into said shed, said sensing means comprising preliminary fluid jet means for applying a pulling force to said weft yarn at a predetermined forward position through a fluid jet while said weft yarn is prevented by said preventing means from moving into said shed, and controlling means for controlling said weft inserting means in accordance with an output signal produced by said sensing means.

2. A weft insertion system according to claim 1, wherein said sensing means includes means for sensing said condition of said weft yarn during ejection of a fluid jet while said weft yarn is prevented from moving into said shed.

3. A weft insertion system according to claim 1 further comprising weft storage means, disposed between said supplying means and said main nozzle.

4. A weft insertion system according to claim 3 wherein said preliminary fluid jet means comprises a secondary fluid jet nozzle, disposed between said storage means and said main nozzle, for ejecting said weft yarn by a fluid jet.

5. A weft insertion system according to claim 3 wherein said storage means comprises a storage drum on which said weft yarn is wound, and detaining means for preventing said weft yarn from proceeding from said storage drum by detaining said weft yarn at a predetermined backward position, and said sensing means further comprises a weft tension sensor, disposed between said backward position and said forward position, for sensing a tension of said weft yarn on which said pulling force is applied by the fluid jet.

6. A weft insertion system according to claim 5 wherein said preliminary fluid jet means is connected with said main nozzle so that said pulling force is applied to said weft yarn by a fluid jet of said main nozzle while said weft yarn is prevented from moving into said shed.

7. A weft insertion system according to claim 5 wherein said preliminary fluid jet means comprises a secondary fluid jet nozzle disposed at said forward position between said storage means and said main nozzle.

8. A weft insertion system according to claim 3 wherein said preliminary fluid jet means comprises a secondary fluid jet nozzle, disposed between said storage means and said main nozzle, for ejecting said weft yarn by a fluid jet, and said sensing means further comprises a condition sensor for sensing a condition of said weft yarn ejected by said secondary nozzle.

9. A weft insertion system according to claim 8 wherein said secondary nozzle is inclined so as to eject said weft yarn upwardly and obliquely, and said condition sensor is a sensor for sensing a height of said weft yarn ejected upwardly by said secondary nozzle.

10. A weft insertion system according to claim 9 further comprising a weft gripper, disposed between said condition sensor and said main nozzle, for gripping said weft yarn.

11. A weft insertion system according to claim 9 further comprising weft measuring means disposed between said condition sensor and said main nozzle, and said weft measuring means comprises a weft storage drum on which said weft yarn is wound, and detaining means for preventing said weft yarn from proceeding from said storage drum of said measuring means to said main nozzle.

12. A weft insertion system according to claim 1 where said fluid jet loom is an air jet type.

13. A weft insertion method for a fluid jet loom, comprising:

a first step of sensing a condition of a weft yarn while preventing said weft yarn from moving into a shed, a second step of producing a corrective signal to control a weft inserting condition, and a third step of allowing said weft yarn to move into said shed, wherein said first step is accomplished by applying a force on said weft yarn by a fluid jet while said weft yarn is prevented from moving into said shed, and sensing said condition of said weft yarn on which said force is applied.

14. A weft insertion method according to claim 5 said first step is accomplished by detaining wherein said weft yarn at a backward position to prevent said weft yarn from moving into said shed, then pulling said weft yarn at a forward position by the fluid jet, and subsequently sensing a tension of said weft yarn at an intermediate position between said forward and backward positions.

15. A weft insertion method according to claim 14 wherein said second step is accomplished, prior to said third step, by adjusting a weft inserting condition.

16. A weft insertion method according to claim 15 wherein said weft inserting condition is a fluid pressure used for a weft insertion.

17. A weft insertion method according to claim 15 wherein said weft inserting condition is a duration of the fluid jet.

18. A weft insertion method according to claim 18 wherein said first step is accomplished by ejecting said weft yarn by the fluid jet while said weft yarn is prevented from moving into said shed, and sensing a condition of said weft yarn ejected.

19. A weft insertion method according to claim 18 wherein said first step is a step of sensing a height of said weft yarn which is ejected upwardly by the fluid jet.

20. A weft insertion method according to claim 15 wherein said first step is performed during ejection of the fluid jet while said weft yarn is prevented from moving into said shed.

* * * * *